United States Patent [19]

Clark

[11] 4,182,396

[45] Jan. 8, 1980

[54] PATTERN PLATE AND PATTERN MATCH PLATE ASSEMBLY

[76] Inventor: Bruce A. Clark, 3023 Snelling Ave., Minneapolis, Minn. 55406

[21] Appl. No.: 949,972

[22] Filed: Oct. 10, 1978

[51] Int. Cl.[2] ..... B22C 7/04

[52] U.S. Cl. ..... 164/243; 164/249

[58] Field of Search ..... 164/239-243, 164/249

[56] References Cited

U.S. PATENT DOCUMENTS

| | | | |
|---|---|---|---|
| 278,370 | 5/1883 | Smith | 164/243 |
| 966,558 | 8/1910 | Johness | 164/239 |
| 1,279,714 | 9/1918 | Lang | 164/241 |
| 1,287,625 | 12/1918 | Bourque | 164/243 |
| 1,428,359 | 9/1922 | Christianson | 164/239 |
| 2,382,053 | 8/1945 | Hagemeyer | 164/241 |
| 2,904,325 | 9/1959 | Jones et al. | 266/274 |
| 3,213,496 | 10/1965 | Waite et al. | 164/241 |
| 3,472,311 | 10/1969 | Rusk | 164/243 |
| 3,789,912 | 2/1974 | Rusk et al. | 164/243 |

OTHER PUBLICATIONS

"Superior Mold Venting System" Superior Foundry Plate, Inc. Publication, 3/9/77, Minneapolis, Minn.

*Primary Examiner*—Robert D. Baldwin
*Assistant Examiner*—K. Y. Lin
*Attorney, Agent, or Firm*—Burd, Braddock & Bartz

[57] ABSTRACT

A pattern plate adapted to support a pattern having a plate body with gage blocks to insure uniform body thickness and a plurality of lug and recess sets for forming a series of pockets and bosses in the cope and drag sections of a sand mold. The lug and recess sets are arranged in end-to-end or chain like arrangement adjacent the ends and sides of the body. Each lug and recess set has a pair of arcuate cavities open to opposite sides of the body and a pair of oppositely directed arcuate lugs. Each lug has an arcuate pad projected outwardly along its crown to form a well in the bottom or top of the pockets in the molds to accommodate loose foreign particles, as sand. In one form of the invention two pattern plates are secured together in a side by side relation to form a match plate pattern assembly. The pads on the lugs space the plate bodies from each other to provide a venting passage between the bodies. Holes in the bodies permit the air to flow through the bodies and passage between the plate to the atmosphere. Each body has externally projecting lugs with pads and recesses to form pockets with wells and bosses that fit into the pockets.

41 Claims, 13 Drawing Figures

FIG.3
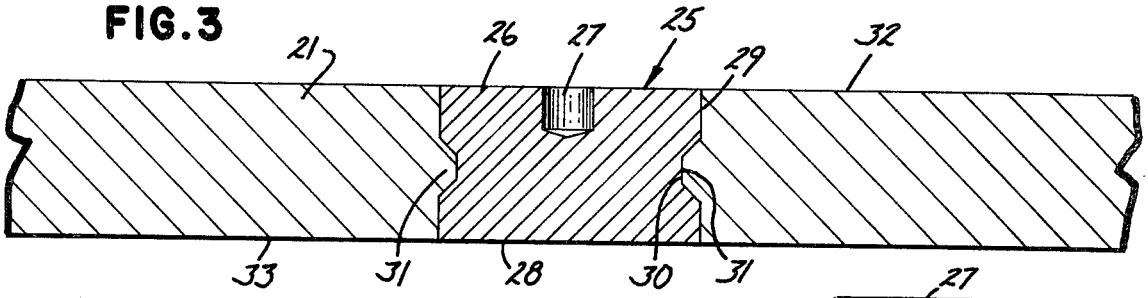
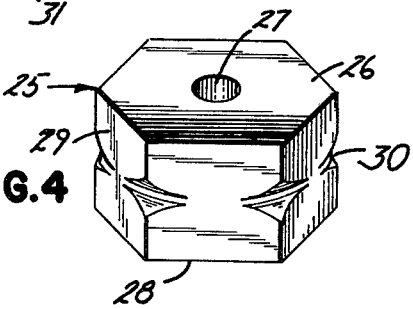
FIG.4
FIG.5
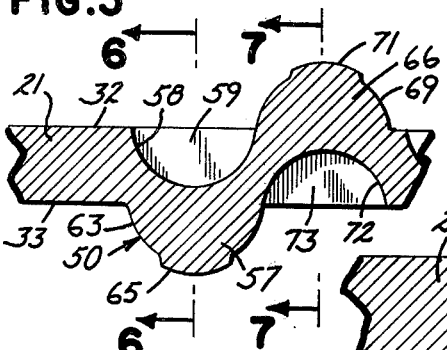
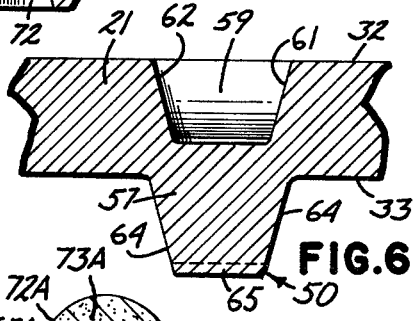
FIG.6
FIG.7
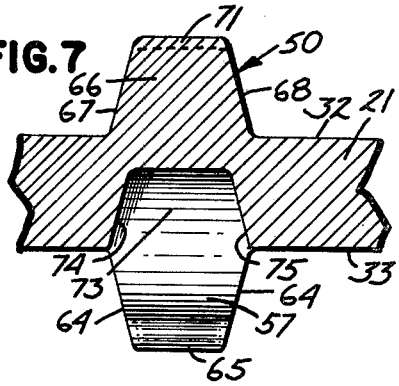
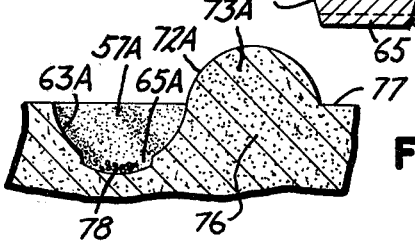
FIG.8
FIG.9
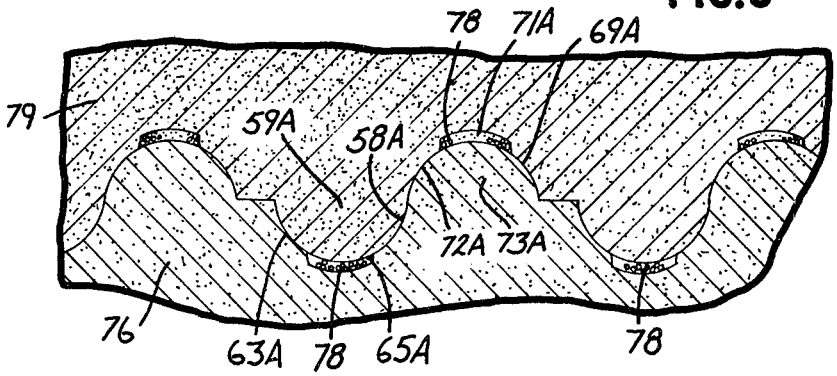

PATTERN PLATE AND PATTERN MATCH PLATE ASSEMBLY

SUMMARY OF THE INVENTION

The invention is directed to a plate for holding a pattern used to make a sand mold. The plate is a generally flat member carrying pattern structures on its opposite sides. The plate is used with a flask to form the cope and drag sections of a sand mold. The pattern plate has a body provided with gage block means to insure uniform body thickness over its working surface. A plurality of lug and recess sets are incorporated in the body and, in use, form interlocking pockets and bosses in the cope and drag sand mold sections. Pad means located on the lugs protect the pattern plate and pattern against damage. The pad means also protect the locking surfaces of the lugs thereby providing the pattern plate with long wear life. The pad means also form wells or traps in the bottom of the pockets of the cope mold section and the top of the pockets in the drag mold section for accommodating loose sand and other foreign materials that may remain in the mold after blow-off. The loose sand, when located in the wells, does not interfere with the interlocking action of the bosses and pockets and does not destroy the mold lock when the mold is closed. The lug and recess sets have radiused locking surfaces which allow maximum mold hardness and minimum edge breakdown. The arcuate shape of the locking surfaces also allows for easy blow out of the loose sand from the locking surfaces. The lug and lock sets are arranged along the sides and ends of the pattern plate in an end-to-end or chain like arrangement. The chain like interlocking pockets and bosses formed by the lug and recess sets insure accurate alignment of the cope and drag sections of the mold and prevent relative movement between the cope and drag sections during the casting process.

Another aspect of the pattern plate is a match plate pattern assembly comprising two pattern plates secured together in a side-by-side relation. The pad means on the lugs serve as spacers to hold the plate bodies apart to enable air to pass through passages in the plate to the atmosphere. The plate assembly is used with automatic molding machines which require the air ventilation arrangements. The lug and recess sets insure the alignment of the plate bodies and uniform thickness around the entire plate edge.

IN THE DRAWINGS:

FIG. 3 is an enlarged sectional view taken along the line 3—3 of FIG. 1;

FIG. 4 is a perspective view of the gage block, shown in section, in FIG. 3;

FIG. 5 is an enlarged sectional view taken along the line 5—5 of FIG. 1;

FIG. 6 is an enlarged sectional view taken along line 6—6 of FIG. 5;

FIG. 7 is an enlarged sectional view taken along line 7—7 of FIG. 5;

FIG. 8 is a fragmentary cross sectional view of a drag sand mold showing the recesses and projections made by the pattern plate;

FIG. 9 is a fragmentary cross sectional view of a complete sand mold showing the cope and drag mold halves in mating relation with each other;

DESCRIPTION OF PREFERRED EMBODIMENTS

Figure 2:
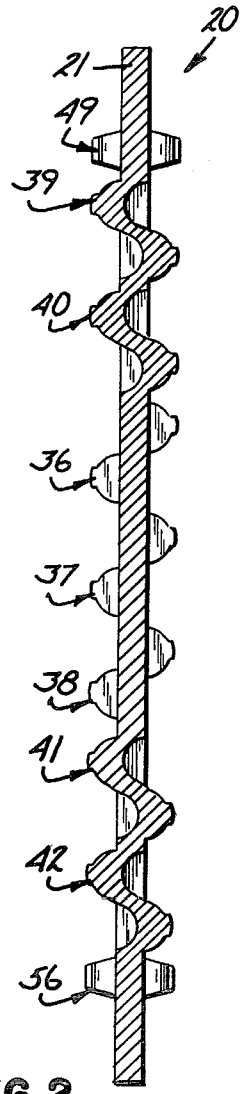
FIG. 2 is a sectional view taken along the line 2—2 of FIG. 1.
Figure 1:
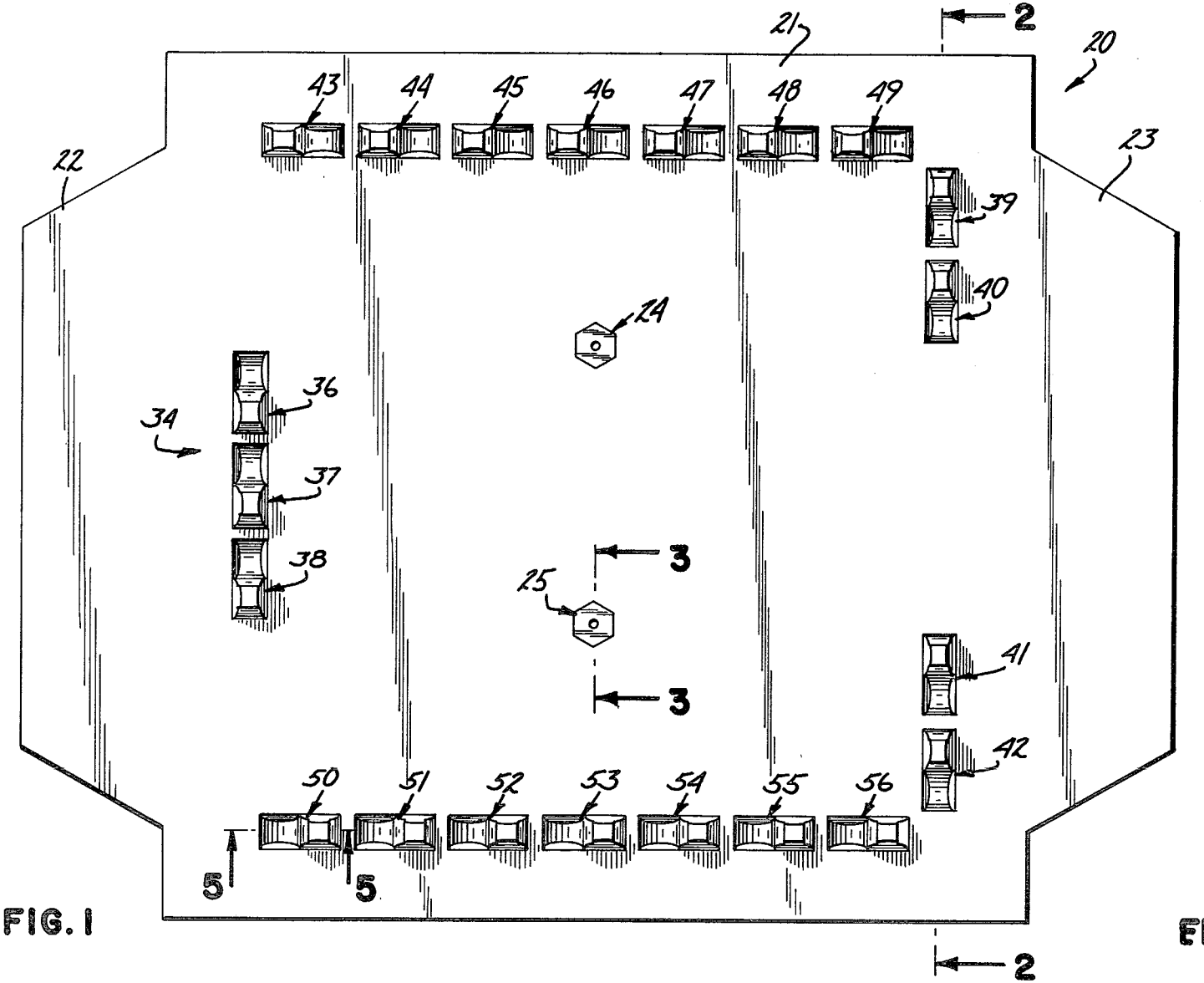
FIG. 1 is a top plan view of a pattern plate according to the invention.

Referring to FIGS. 1 and 2, there is shown a pattern plate indicated generally at 20 used as a mounting member for the top and bottom sections of a pattern. Pattern plate 20 is used in the foundry with a four-sided open top and bottom box called a flask to produce a sand mold having an internal cavity corresponding to the pattern mounted on the plate. A sand mold is formed in two sections known as a cope section and a drag section. Conventional squeeze molding machines are used to compress foundry sand into engagement with opposite sides of the pattern plate and pattern mounted thereon to form the cope and drag sections.

Pattern plate 20 has a flat rectangular metal plate member or body 21 having laterally outwardly directed flat end projections or flanges 22 and 23. Flanges 22 and 23 serve as handles to facilitate the removal of plate 20 from the flask during the molding procedure. Pattern plate 20 is usually made of cast aluminum having a substantially uniform thickness. For example, body 21 and flanges 22 and 23 can be cast of aluminum having a 1.7 cm or ½ inch thickness. The size of the pattern plate 20 varies with the type and size of pattern attached to opposite sides of the plate.

A pair of gage blocks 24 and 25 are used in the process of casting plate 20 to insure uniform thickness of the plate. Referring to FIGS. 3 and 4, gage block 25 is cast into body 21. Gage blocks 24 and 25 insure that the pattern plate 20 has a top flat surface 32 that is parallel to a bottom surface 33 and insures a flat pattern plate that has a uniform metal thickness. Gage blocks 24 and 25 are identical in structure. The following description is limited to gage block 25.

Gage block 25 has a flat top surface 26 having a central bore or hole 27. Hole 27 is used to accommodate a pin in the casting mold to position the gage block in the mold. Gage block 25 has a flat bottom surface 28 and a hexagonal shaped side wall 29. Side wall 29 has recesses 30 in the corners of the box shaped wall for accommodating portions 31 of the metal of body 21. The portions of metal 31 in recesses 30 lock gage block 25 to body 31.

Pattern plate 20 has structures indicated generally at 34 providing cope and drag aligning means. Structures 34 are used to form complementary recesses and projections in the cope and drag mold sections which accurately align the cope and drag sections with each other. As shown in FIGS. 1 and 2, structures 34 comprise a plurality of lug and recess sets 36–56 located along the sides and ends of body 21. Lug and recess sets 36–38 are located centrally adjacent flange 22. A pair of lug and recess sets 39 and 40 are located adjacent the upper or righthand corner of body 21 adjacent flange 23. A second pair of lug and recess sets 41 and 42 are located in the left lower corner of body 21 adjacent flange 23. A first end-to-end series of lug and recess sets 43–49 are located along and extend parallel to the upper edge of body 21. A second series of end-to-end lug and recess sets 50–56 are located parallel to and along the lower edge of body 21. The lug and recess sets 36–56 are spaced from the ends and side edges of body 21 so as to form complementary recesses and projections in the cope and drag sections of the mold. The number and arrangement of lug and recess sets 36–56, shown in FIGS. 1 and 2, is a preferred embodiment. Other numbers and arrangements of lug and recess sets can be incorporated into pattern plate 20.

Referring to FIGS. 5 and 6, there is shown enlarged sectional views of lug and recess set 50. All lug and recess sets 36–56 are identical in structure to lug and recess set 50. The following description is limited to lug and recess set 50.

Lug and recess set 50 has a first or drag lug 57 projected below the lower surface 33 of body 21. Lug 57 is aligned with an inside concave surface 58 open to the top surface 32 of body 21. Surface 58 forms a recess 59 with outwardly tapering side walls 61 and 62. Lug 57 has a convex surface 63. The curvature of surface 63 is about the same as the curvature of surface 58. Surfaces 58 and 63 are arcuate or generally semicircular. Lug 57 has outwardly and downwardly converging side walls 64. Preferably, each side wall 64 has a draft of about 15 degrees. Side walls 64 taper in the direction of taper of walls 61 and 62 so that the sand projection formed by recess 59 fits into the sand cavity formed by lug 57. The radius of curvature of the outer surface of lug 57 is the same as the radius of curvature of concave surface 58. An outwardly directed pad 65 is located on the mid-section of surface 63. Pad 65 has an arcuate outer surface and tapered ends. As shown in FIG. 6, pad 65 extends the width of lug 57.

Lug and recess set 50 has a second upwardly or cope lug 66 having upwardly converging side walls 67 and 68 and a convex outer surface or face 69. An outwardly directed pad 71 is located in the center portion of face 69. As shown in FIG. 7, pad 71 extends the full width of the top of lug 66 and has an arcuate outer surface generally concentric with the curvature of the face 69. The radius of curvature of the outer arcuate surface of lug 71 is the same as the radius of curvature of concave surface 72. Pads 65 and 71 serve as wear members on the crowns of lug surfaces 63 and 69 that protect surfaces 63 and 69 and the pattern plate. This increases the wear life of the pattern plate. The pads 65 and 71 also form wells or reservoir chambers in the sand mold sections to accommodate or trap loose foreign material, as sand.

The lower or drag surface 33 has an upwardly extended concave surface or face 72 forming a recess or pocket 73. Pocket 73 has downwardly and outwardly tapering side walls 74 and 75. As shown in FIG. 7, side walls 74 and 75 have a taper of approximately 15 degrees. The curvature of surface 72 is substantially the same as the curvature of the convex surface 63. Both surfaces have arcuate centers that are located along the same transverse line. The transverse line bisects pad 71.

An example of a lug and recess set is as follows. Recesses 59 and 73 and lugs 57 and 66 have a base width of 0.625 inch and 15° tapered sides. The radius of curvature of recesses 59 and 73 is 0.45 inch and an arcuate length of 173°. The radial center is above the plane of plate surface 32. The radial center of recess 73 is below plate surface 33. The lugs 65 and 71 of recess 59 have arcuate lengths of 60° and a radius of curvature of 0.44 inch. The radial centers of lugs 65 and 71 are on the planes of plate surfaces 32 and 33, respectively.

Referring to FIG. 8, there is shown a sectional or profile of a drag mold 76 formed from molding sand. Section 76 has a generally flat top surface 77 formed by the bottom surface 33 of pattern plate 20. Surface 77 also contains the mold cavity (not shown) formed by the pattern secured to the surface 33. The recess and projections formed in the drag mold section formed by lug and recess set 50 are identified with the same lug and recess numerals and suffix A. First lug 57 produces the pocket or cavity 57A. Cavity 57A has an arcuately downwardly directed surface 63A with a bottom well or trap chamber 65A for accummulating dirt and sand particles 78. Recess 73 produces a boss or tooth 73A. Surface 72 forms the arcuate surface 72A. The remaining lug and recess sets produce a series of pockets and bosses identical in shape and size to the pockets and boss shown in FIG. 8.

Referring to FIG. 9, there is shown cope mold section 79 located in assembled relation with drag mold section 76. Sand mold sections 76 and 79 are made by compressing foundry sand on opposite sides of pattern plate 20. The mold sections 76 and 79 are removed from the pattern plate 20 and placed in face-to-face positions, as shown in FIG. 9. The bosses and pockets formed by the lug and recess sets 36–56 in the mold sections 76 and 79 interlock to prevent shifting of the mold sections 76 and 79 relative to each other during the casting process.

Cope mold section 79 has a downwardly directed lug 59A having an outer arcuate surface 58A in engagement with the concave arcuate surface 63A of drag mold section 76. The lug 59A does not extend into chamber 65A whereby the chamber can accumulate dirt and sand particles 78 without interfering with the fit of the cope mold section 79 on the drag mold section 76. Cope mold section 79 has an upwardly directed concave surface 69A located in surface engagement with convex curved surface 72A of the lug 73A of drag mold section 76. Chamber 71A is open for accommodating the dirt and sand particles 78. The bosses and pockets in the cope and drag mold sections comprise chain like interlocking structures which insure accurate alignment of the cope and drag sections and prevent relative movement between these sections during the casting process. Each pocket has wells or trap chambers similar to chambers 65A and 71A to accommodate foreign matter, as loose sand and other particles. The wells locate the foreign matter in locations where the foreign matter does not interfere with nesting and alignment of the cope and drag mold sections.

Figure 10:
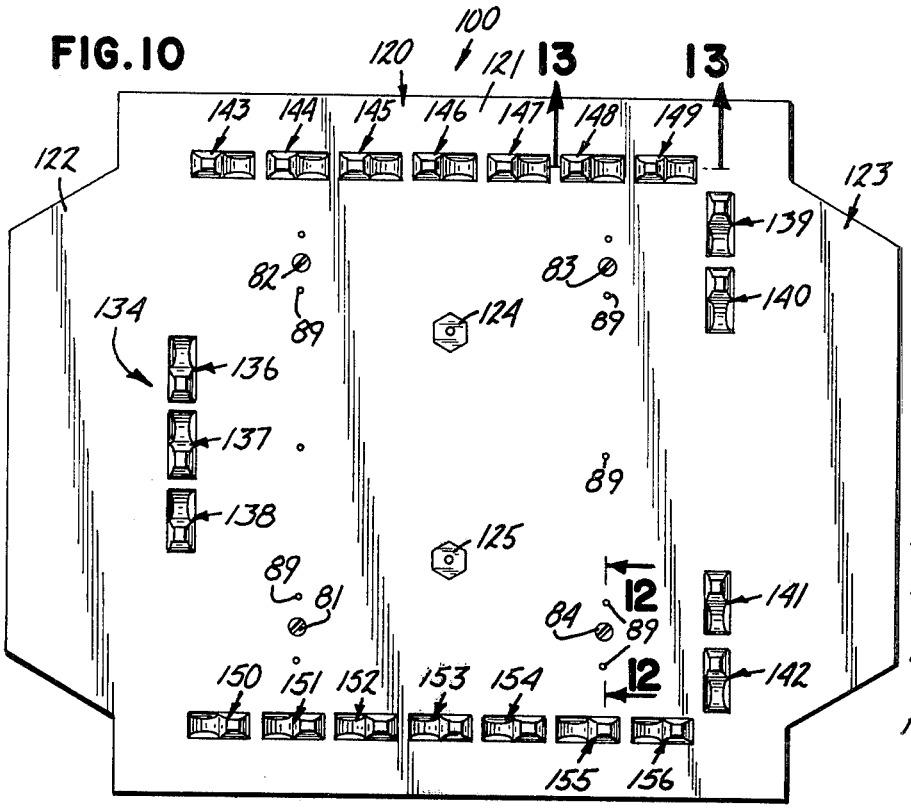
FIG. 10 is a top plan view of a match pattern plate assembly.
Figure 11:
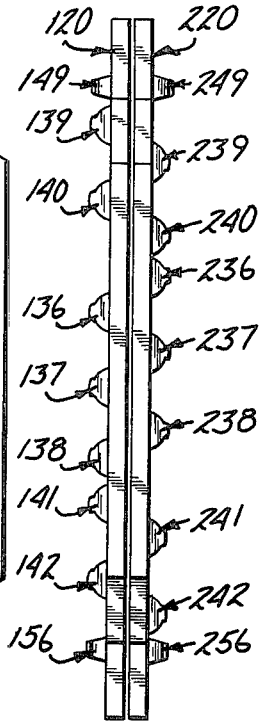
FIG. 11 is an elevational view of the right end of FIG. 10.
Figure 12:
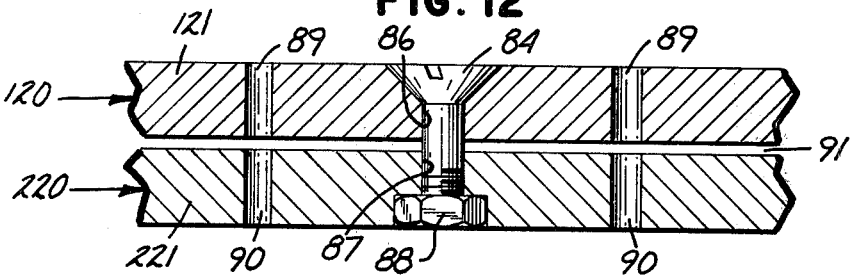
FIG. 12 is a cross sectional view taken along the line 12—12 of FIG. 10.

Referring to FIGS. 10–12, there is shown a pattern match plate assembly indicated generally at 100. Assembly 100 comprises a pair of pattern plates 120 and 220. Plates 120 and 220 are identical to the pattern plate 20. They are located in aligned side-by-side relation and secured together with a plurality of bolts 81, 82, 83, and 84. As shown in FIG. 12, the bolt 84 extends through aligned holes 86 and 87 in the bodies 121 and 221 of pattern plates 120 and 220. Bolt 84 is a stove bolt having a conical head with a flat surface that coincides with the top surface of pattern plate body 121. Nut 88 threaded on bolt 86 is located in a recess in body 221. Vent holes 89 and 90 in bodies 121 and 221 provide air escape passages for air collected in the space 91 between pattern plate bodies 121 and 221. The vent holes are placed in bodies 121 and 221 in selected locations to insure that air trapped by the sand pressed against the opposite sides of pattern plates 120 and 220 by an automatic molding machine is vented to the atmosphere.

Figure 13:
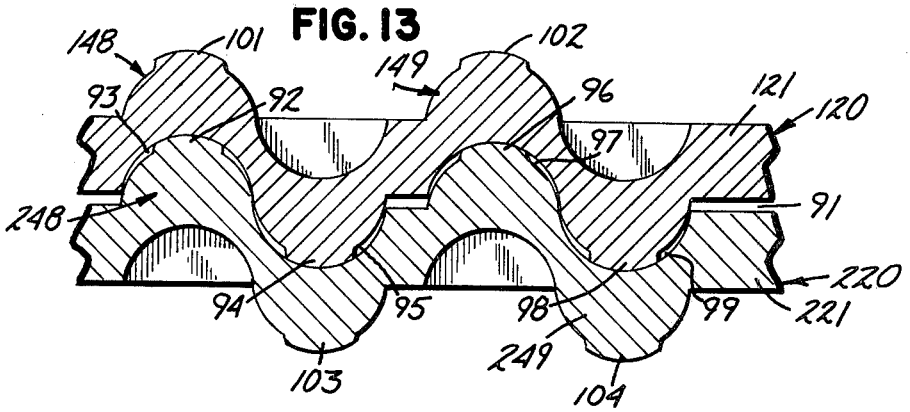
FIG. 13 is an enlarged sectional view taken along the line 13—13 of FIG. 10.

Referring to FIG. 13, there is shown an enlarged cross sectional view of the lug and recess sets 148 and 149 of pattern plate 120 in assembled association with lug and recess sets 284 and 249 of pattern plate 220. Pattern plates 120 and 220 are spaced from each other by pads 92, 94, 96, and 98 which bear against the bottom of the recesses 93, 95, 97, and 99, respectively. Pads 92, 94, 96, and 98 serve as spacers to insure a substantially continuous and uniform space 91 between pattern plates 120 and 220. Pads 101 and 102 on pattern plate 120 and pads 103 and 104 on pattern plate 220 serve as wear members which protect the external convex surfaces of the lugs. The interlocking lugs and recess on plate bodies 121 and 221 assures an accurate alignment between the plates and uniform thickness around the entire pattern assembly.

Pattern plate assembly 100 is used with automatic molding machines to simultaneously make both the cope and drag mold sections. The machines compress the foundry sand against the opposite sides of the plate assembly 100. The lug and recess sets 136–156 form projections and depressions in the cope mold section. The corresponding lug and recess sets in the pattern plate 220 form projections and depressions in the drag mold section. The projections and recesses in the cope and drag mold sections are complementary and fit together in an interlocking relationship, as shown in FIG. 9.

While there has been shown and described the preferred embodiments of the pattern plate assembly of the invention, it is understood that changes in the size and the number of lug and recess sets used with the plate can be changed without departing from the invention. The invention is defined in the following claims.

I claim:

1. A pattern plate for supporting a pattern useable to make a sand mold having cope and drag mold sections comprising: a body having a first flat surface and a second flat surface located parallel to the first surface for carrying a pattern, and a plurality of lug and recess sets located in said body to provide cooperating pockets and bosses in the cope and drag mold sections, each lug having a convex surface and inwardly tapering side walls, said convex surface including generally centrally located pad means, said pad means providing a well in the pocket in the mold sections to accommodate foreign materials, each recess having a concave surface substantially corresponding in size and shape with the lug whereby a boss formed in one mold section fits into a pocket in the other mold section.

2. The plate of claim 1 wherein: the body is a flat plate member.

3. The plate of claim 2 including: gage block means mounted in side plate member whereby the plate member has uniform thickness between the first surface and second surface.

4. The plate of claim 1 wherein: said body is a plate member having sides and ends, said plurality of lug and recess sets comprising a first series of end-to-end lug and recess sets located adjacent one end of the plate member, a second series of end-to-end lug and recess sets located adjacent the other end of the plate member, a third series of end-to-end lug and recess sets located adjacent one side of the plate member, and a fourth series of end-to-end lug and recess sets located adjacent the other side of the plate member.

5. The plate of claim 4 wherein: the third and fourth series of lug and recess sets have the same number of lug and recess sets and are parallel to each other adjacent opposite sides of the plate member.

6. The plate of claim 1 wherein: each lug has a generally semi-circular convex outer surface.

7. The plate of claim 6 wherein: each pad means has a width equal to the width of said outer surface.

8. The plate of claim 7 wherein: each pad means has a convex outer surface.

9. The plate of claim 1 wherein: each recess has a generally semi-circular concave bottom surface.

10. The plate of claim 9 wherein: each recess has inwardly converging side walls.

11. The plate of claim 1 wherein: each lug and recess set has a pair of lugs and a pair of recesses.

12. The plate of claim 11 wherein: one lug projects from the first surface of the body and the other lug projects from the second surface of the body, and one recess is open to the first surface of the body and the other recess is open to the second surface of the body.

13. The plate of claim 12 wherein: said one lug and one recess have convex and concave surfaces, respectively, that are continuous with each other, and said other lug and other recess have convex and concave surfaces, respectively, that are continuous with each other.

14. The plate of claim 13 wherein: each of said convex and concave surfaces have a generally semi-circular shape.

15. A pattern plate for supporting a pattern useable to make a sand mold having cope and drag mold sections comprising: body means having opposite surfaces for carrying a pattern, and a plurality of lug and recess sets located in said body means to provide cooperating pockets and bosses in the cope and drag mold sections, each lug having an outer surface, said outer surface including generally centrally located pad means for forming a well in the pocket in the mold sections to accommodate foreign materials, each recess having a surface substantially corresponding in size and shape with the lug surface whereby a boss formed in one mold section fits into the pocket of the other mold section.

16. The plate of claim 15 wherein: each lug has a generally semi-circular convex outer surface.

17. The plate of claim 10 wherein: each lug has outwardly converging side walls and each recess has inwardly converging side walls.

18. The plate of claim 15 wherein: each pad means has a width generally equal to the width of the outer surface of the pad means.

19. The plate of claim 18 wherein: each pad means has an arcuate outer surface.

20. The plate of claim 15 wherein: each pad means has an arcuate outer surface.

21. The plate of claim 15 wherein: each recess has a generally semi-circular concave bottom surface.

22. The plate of claim 21 wherein: each recess has inwardly converging side walls.

23. The plate of claim 15 wherein: each lug and recess set has a pair of lugs and a pair of recesses.

24. The plate of claim 23 wherein: one lug projects from the first surface of the body and the other lug projects from the second surface of the body, and one recess is open to the first surface of the body and the other recess is open to the second surface of the body.

25. The plate of claim 24 wherein: said one lug and one recess have convex and concave surfaces, respectively, that are continuous with each other, and said other lug and other recess have convex and concave surfaces, respectively, that are continuous with each other.

26. The plate of claim 25 wherein: each of said convex and concave surfaces have a generally semi-circular shape.

27. A pattern match plate assembly comprising:

(a) first and second pattern plates, each of which includes a body having a first flat surface and a second flat surface located parallel to the first surface for carrying a pattern, and a plurality of lug and recess sets located in said body to provide cooperating pockets and bosses in the cope and drag mold sections, each lug having a convex surface and inwardly tapering side walls, said convex surface including generally centrally located pad means, said pad means providing a well in the pocket in the mold sections to accommodate foreign materials, each recess having a concave surface substantially corresponding in size and shape with the lug whereby a boss formed in one mold section fits into a pocket in the other mold section;

(b) said first and second pattern plates being located in side by side relation with the lugs projected from one side of the first plate located in recesses in the adjacent side of the second plate and the lugs of the adjacent side of the second plate being located in the recesses in the one side of the first plate;

(c) said pad means on the lugs spacing the bodies of the first and second pattern plates apart;

(d) said bodies of the first and second pattern plates having vent holes open to the space between said bodies, and;

(e) means securing the bodies together.

28. The assembly of claim 27 wherein: each lug has a generally semi-circular convex outer surface and each recess has a generally semi-circular concave surface.

29. The assembly of claim 28 wherein: each pad means has a width generally equal to the width of said outer surface.

30. The assembly of claim 29 wherein: each pad means has an arcuate outer surface.

31. The assembly of claim 27 wherein: each pad means has an arcuate outer surface.

32. A pattern match plate assembly comprising: a first pattern plate having first body means with opposite surfaces, and a plurality of first lug and recess sets located in said first body means, each first lug having an outer surface including generally centrally located first pad means, each first recess having a surface substantially corresponding in size and shape with the first lug outer surface, a second pattern plate having second body means with opposite surfaces and a plurality of second lug and recess sets located in said second body means, each second lug having an outer surface including generally centrally located second pad means, each second recess having a surface substantially corresponding in size and shape with the second lug surface, said first and second body means being located in side by side relation with the first lugs projected from one side of the first body means located in the second recesses in the adjacent side of the second body means and the second lugs of the adjacent side of the second body means being located in the first recesses in the one side of the first body means, said pad means on the first and second lugs located in the first and second recesses, respectively, spacing the first and second bodies apart, said first and second bodies having vent holes open to the space between said first and second bodies, and means securing the first and second bodies together.

33. The assembly of claim 32 wherein: each lug has a generally semi-circular convex outer surface and each recess has a generally semi-circular concave surface.

34. The assembly of claim 33 wherein: each pad means has a width generally equal to the width of said outer surface.

35. The assembly of claim 34 wherein: each pad means has an arcuate outer surface.

36. The assembly of claim 33 wherein: each pad means has an arcuate convex outer surface.

37. The assembly of claim 32 wherein: each lug has a generally semi-circular convex outer surface and outwardly converging side walls, and each recess has a generally semi-circular concave surface and inwardly converging side walls.

38. The assembly of claim 32 wherein: each lug and recess set on each of the bodies has a pair of lugs and a pair of recesses.

39. The assembly of claim 38 wherein: one lug of each body projects from the first surface of the body and the other lug of each body projects from the second surface of the body, one recess of each body is open to the first surface of the body and the other recess of each body is open to the second surface of the body.

40. The assembly of claim 39 wherein: said one lug and one recess of each body has convex and concave surfaces, respectively, that are continuous with each other, and said other lug of each body and other recess of each body has convex and concave surfaces, respectively, that are continuous with each other.

41. The assembly of claim 40 wherein: each of said convex and concave surfaces have a generally semi-circular shape.

* * * * *

UNITED STATES PATENT AND TRADEMARK OFFICE

CERTIFICATE OF CORRECTION

PATENT NO. : 4,182,396

DATED : January 8, 1980

INVENTOR(S) : Bruce A. Clark

It is certified that error appears in the above-identified patent and that said Letters Patent are hereby corrected as shown below:

Column 6, line 46, "10" should be --16--.

Signed and Sealed this

*Twenty-second* Day of *April 1980*

[SEAL]

*Attest:*

SIDNEY A. DIAMOND

*Attesting Officer*

*Commissioner of Patents and Trademarks*